US010959558B1

(12) United States Patent
Bernstein et al.

(10) Patent No.: US 10,959,558 B1
(45) Date of Patent: Mar. 30, 2021

(54) HANGER WITH FOLDING HOOK AND COLLAPSIBLE ARMS

(71) Applicant: SJBEE LLC, Hewlett, NY (US)

(72) Inventors: Steven J. Bernstein, Hewlett, NY (US); Leslie S. Blitz, New Hyde Park, NY (US)

(73) Assignee: SJBEE LLC, Hewlett, NY (US)

( * ) Notice: Subject to any disclaimer, the term of this patent is extended or adjusted under 35 U.S.C. 154(b) by 59 days.

(21) Appl. No.: 16/130,436

(22) Filed: Sep. 13, 2018

Related U.S. Application Data

(60) Provisional application No. 62/559,767, filed on Sep. 18, 2017.

(51) Int. Cl.
*A47G 25/40* (2006.01)
*A47G 25/18* (2006.01)

(52) U.S. Cl.
CPC ..... *A47G 25/4023* (2013.01); *A47G 25/183* (2013.01)

(58) Field of Classification Search
CPC .. A47G 25/4023; A47G 25/183; A47G 25/40; A47G 25/4015; A47G 25/403; A47G 25/14; A47G 25/1485; A47G 25/1492; A47G 25/16; A47G 25/18; A47G 25/2025; A47G 25/4092
USPC ..... D6/315–319, 324, 327, 328
See application file for complete search history.

(56) References Cited

U.S. PATENT DOCUMENTS

| | | | | | |
|---|---|---|---|---|---|
| 864,634 | A * | 8/1907 | Fellroth | A47G 25/18 | 223/89 |
| 1,422,782 | A * | 7/1922 | Rattan | A47G 25/18 | 223/89 |
| 1,682,626 | A * | 8/1928 | Peckham | A47G 25/4023 | 223/89 |
| 2,232,249 | A * | 2/1941 | Losin | A47G 25/4023 | 24/716 |
| 2,413,221 | A * | 12/1946 | Elston | A47G 25/4023 | 223/89 |
| 2,586,913 | A * | 2/1952 | Burns | A47G 25/4023 | 223/94 |
| 2,716,513 | A * | 8/1955 | Braunstein | A47G 25/4023 | 223/94 |
| 2,728,499 | A * | 12/1955 | Mueller | A47G 25/4023 | 223/94 |
| 3,401,855 | A * | 9/1968 | Balzer | A47G 25/403 | 223/94 |
| 3,790,046 | A * | 2/1974 | Rooney | A47G 25/32 | 223/92 |
| 4,168,791 | A * | 9/1979 | Clark, Jr. | A47G 25/50 | 223/94 |
| 6,065,652 | A * | 5/2000 | Dooling-Sherman | A47G 25/486 | 223/90 |
| 7,243,823 | B2 * | 7/2007 | Cresap | A47G 25/4023 | 223/85 |

(Continued)

*Primary Examiner* — Ismael Izaguirre
(74) *Attorney, Agent, or Firm* — Ostrolenk Faber LLP

(57) ABSTRACT

A garment hanger with a hook either metal or plastic that moves between substantially vertical and horizontal positions or may also remain in a stationary upright position with pivotable and collapsible arms with respect to the hanger body to move between substantially vertical and horizontal positions enable the hanger to have use in e-commerce as well as brick and mortar stores by maximizing the versatility of the garment hanger.

12 Claims, 10 Drawing Sheets

(56) References Cited

U.S. PATENT DOCUMENTS

| | | | | |
|---|---|---|---|---|
| 7,828,179 | B2 * | 11/2010 | Sprovieri | A47G 25/4023 223/94 |
| 9,492,025 | B1 * | 11/2016 | Wu | A47G 25/20 |
| 9,655,466 | B1 * | 5/2017 | Bernstein | A47G 25/1428 |
| 2012/0043356 | A1 * | 2/2012 | Rubino | A47G 25/28 223/85 |
| 2016/0088965 | A1 * | 3/2016 | Hansen | A47G 25/32 223/85 |

* cited by examiner

HANGER WITH FOLDING HOOK AND COLLAPSIBLE ARMS

RELATED APPLICATIONS

This application claims the priority of U.S. Provisional Patent Application Ser. No. 62/559,767, filed Sep. 18, 2017 and Ser. No. 62/588,597, Filed Nov. 20, 2017, the contents and inventions of which are wholly incorporated herein.

BACKGROUND OF THE INVENTION

Garment hangers have been around for hundreds of years. Modern day retail use garment hangers have many packaging and travel requirements and specifications intended to increase efficiency in the supplier to retailer pipeline by minimizing order to sales floor or e-commerce shipment time. Many garments are manufactured all over the world and then shipped to United States (or other countries) pre-hung as a "garment on hanger" from the originating garment manufacturing location. In order to save time and expense at the retail level the garment is placed on the hanger at the point of garment manufacturing and placed into a shipping box or container. Upon delivery to the retailer location, the retailer has to remove the "garment on hanger" from the box or container and hang it appropriately in distribution centers for e-commerce shipment or further shipment to an individual store.

Present day Omni Channel process in the industry dictates if the garment will go directly to the sales floor since the hanger will stay on the garment, but if it is to be shipped in e-commerce packaging, there is a need for the hanger to be easily removed without harming the hanger or unbuttoning the garment to remove the hanger. Since the retailer or the garment manufacturer does not always know which garment will go to either brick and mortar stores or e-commerce, the need for a garment hanger that can be used for both channels without being changed is required.

SUMMARY OF THE INVENTION

This invention relates to the need for an individual hanger to be able to be used both at the retail level and for e-commerce shipments by using a combination of folding hook and collapsible arms. The hanger structure of this invention will have the option of a hook that folds and arms that collapse when needed or remain as a standard hanger when used as a commercial hanger. This invention of this hanger allows for quick easy assembly and low cost production further reducing its final cost.

The subject hanger will allow easier insertion or removal of the hanger in a closed neck garment. Additionally, when both arms and hook are folded or collapsed, there is a footprint reduction of the hanger, creating space savings in packaging and transport. A benefit of this invention is quick and easy assembly as well as low cost production. Also the same pivoting mechanism can be used for changing both the hook and arm positions and also can be used as a modular system to connect differently shaped and purposed hangers. A sizer tab can be fitted on the hanger. This design for collapsible arms also works with stationary plastic or stationary metal hooks.

Today's dimensional packaging shipping costs have made for the appreciation of smaller shipping boxes saving cost based on the dimension of the box. A smaller footprint of a hanger when collapsed will allow for smaller shipping cartons, and this invention meets that objective. Further, the arms as manufactured are interchangeable, which reduces costs of manufacture and assembly.

DETAILED DESCRIPTION OF DRAWINGS

Figure 1A:
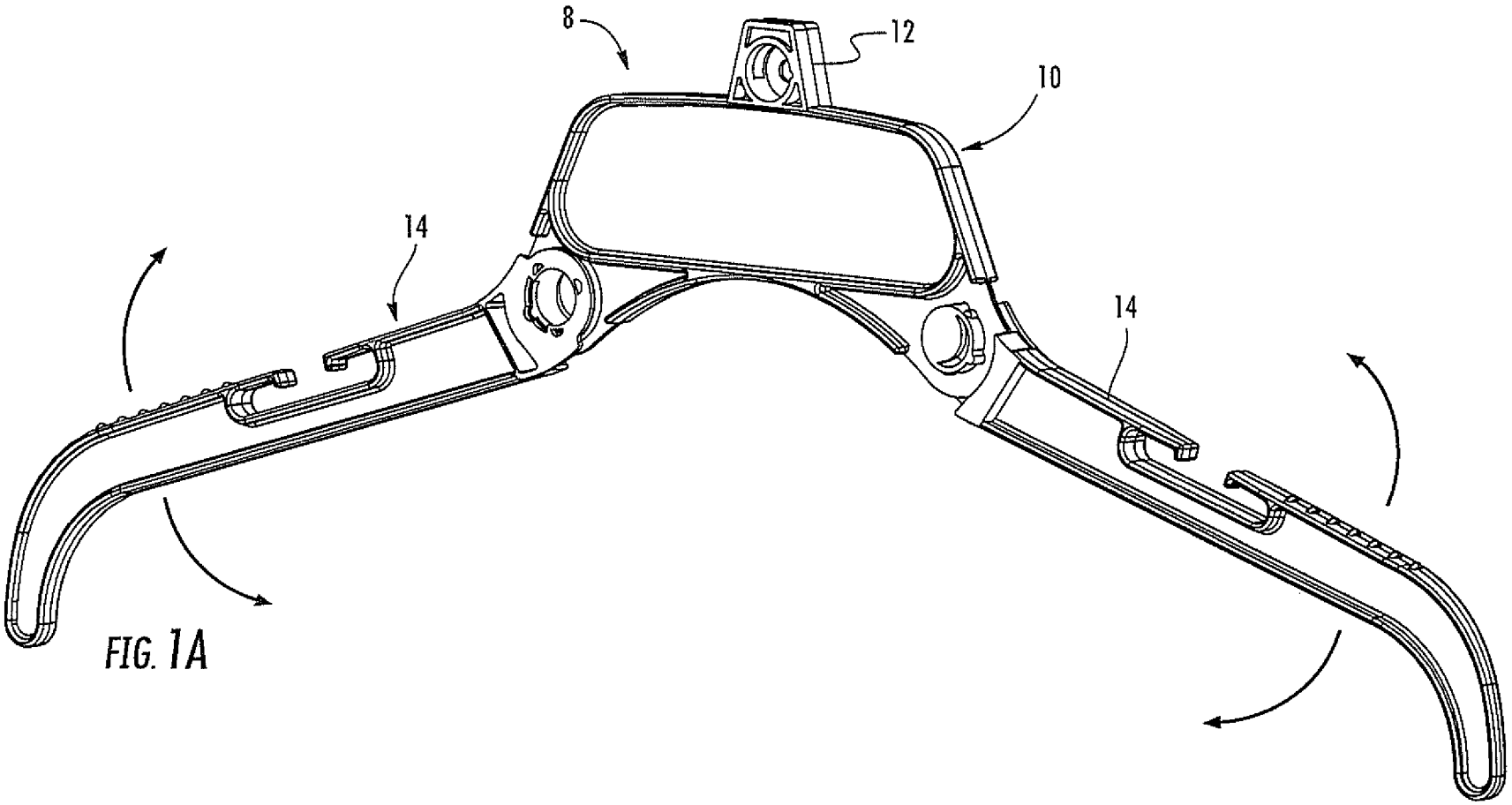
FIG. 1*a* is a perspective view of the hanger of the present invention with collapsible arms.

Referring to FIG. 1*a*, a hanger 8 is shown having central neck 10 with hook and sizer receiver mount 12 on top thereof. The hanger is preferably of an I beam construction. Hanger 8 is shown as a full hanger with the hanger arms 14 in the upright open standard horizontal position. This design is not limited to an I beam construction. In one preferred embodiment (FIG. 6), central neck 10 includes a coordinate loop for receiving a second similar hanger or it could be for an entirely different hanger silhouette. This invention also allows for a modular system using the coordinate loop to hold different shape and use hangers sold together as a unit.

In accordance with this invention, the arms 14 are pivotably connected to the central neck 10 at pivots 16 (FIG. 1*b*) located on either side at the bottom of central neck 10

Figure 1B:
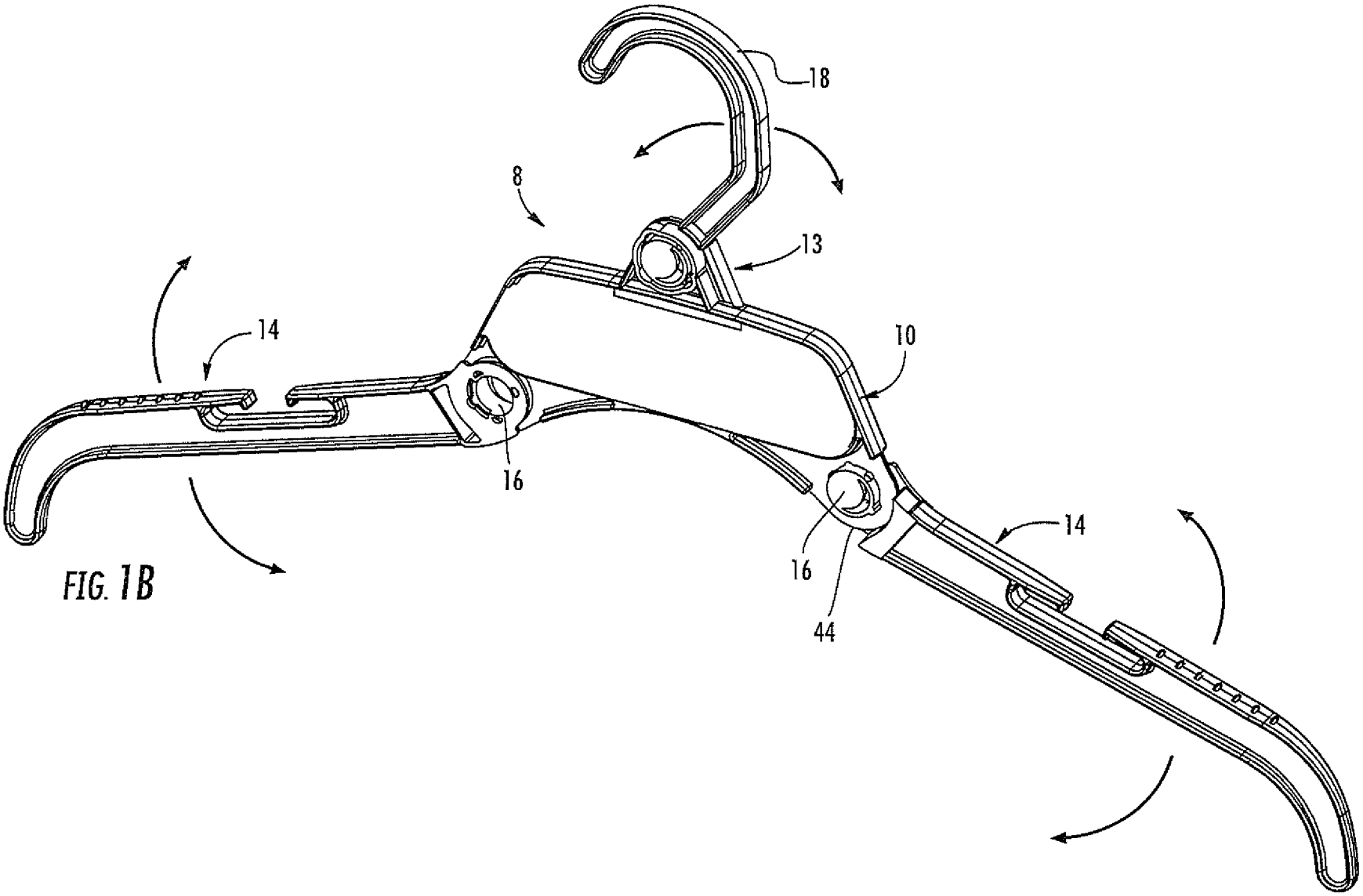
FIG. 1*b* is a perspective view similar to FIG. 1*a* with the collapsible hook and arms.

FIG. 1*b* shows hanger 8 similar to FIG. 1*a* except that foldable plastic hook 18 pivotably connected to mount 12 is added central neck 10 with plastic hook sizer mount 13 formed as an I beam construction.

Figure 1C:
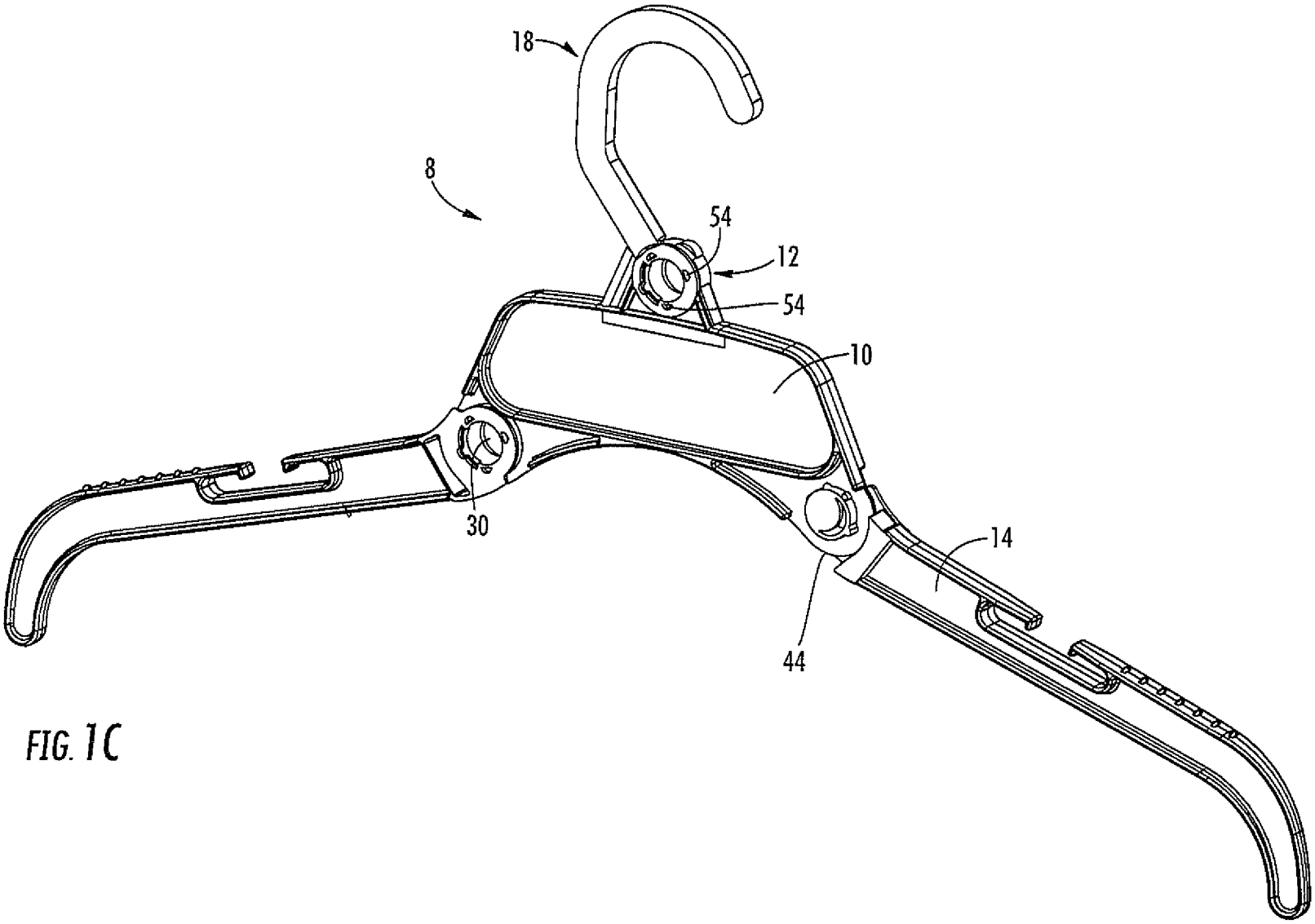
FIG. 1*c* is a rear perspective view of the hanger of FIG. 1*b;*
Figure 2A:
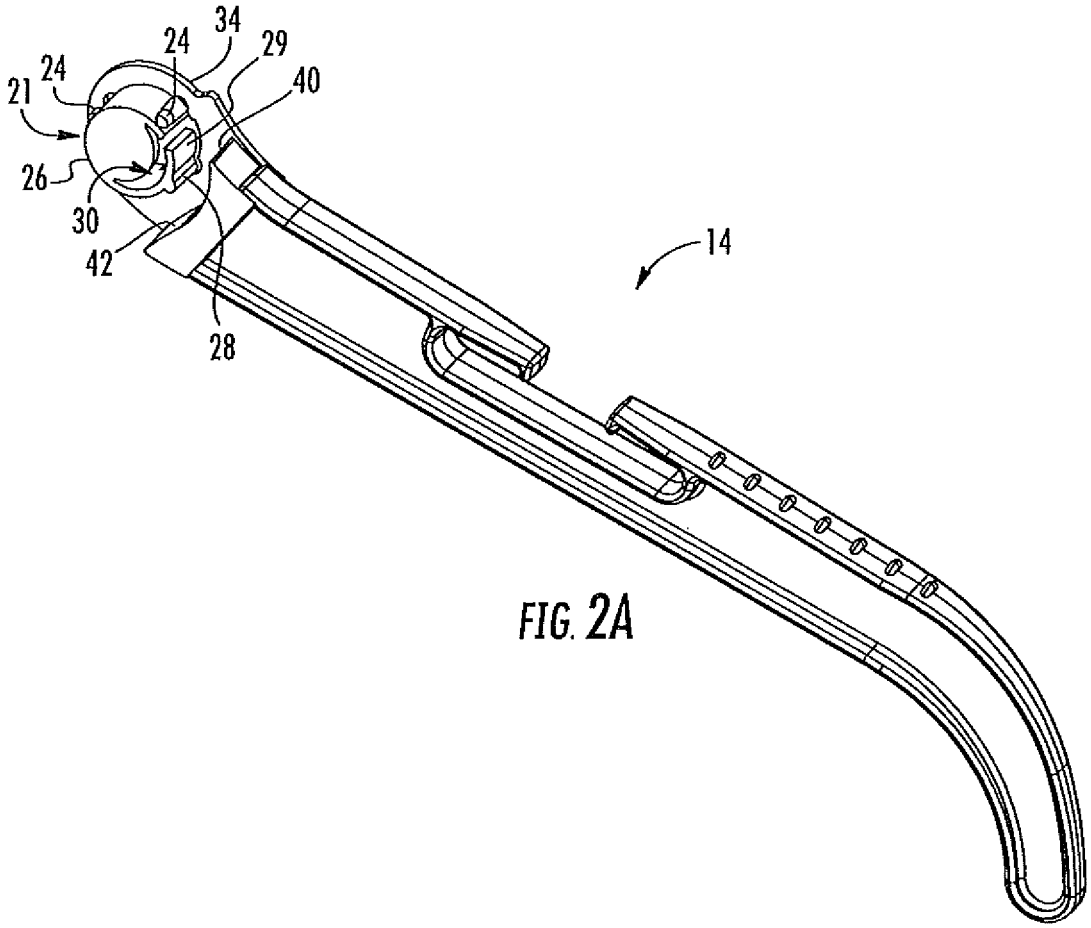
FIG. 2*a* is a front perspective view of a collapsible arm.
Figure 2B:
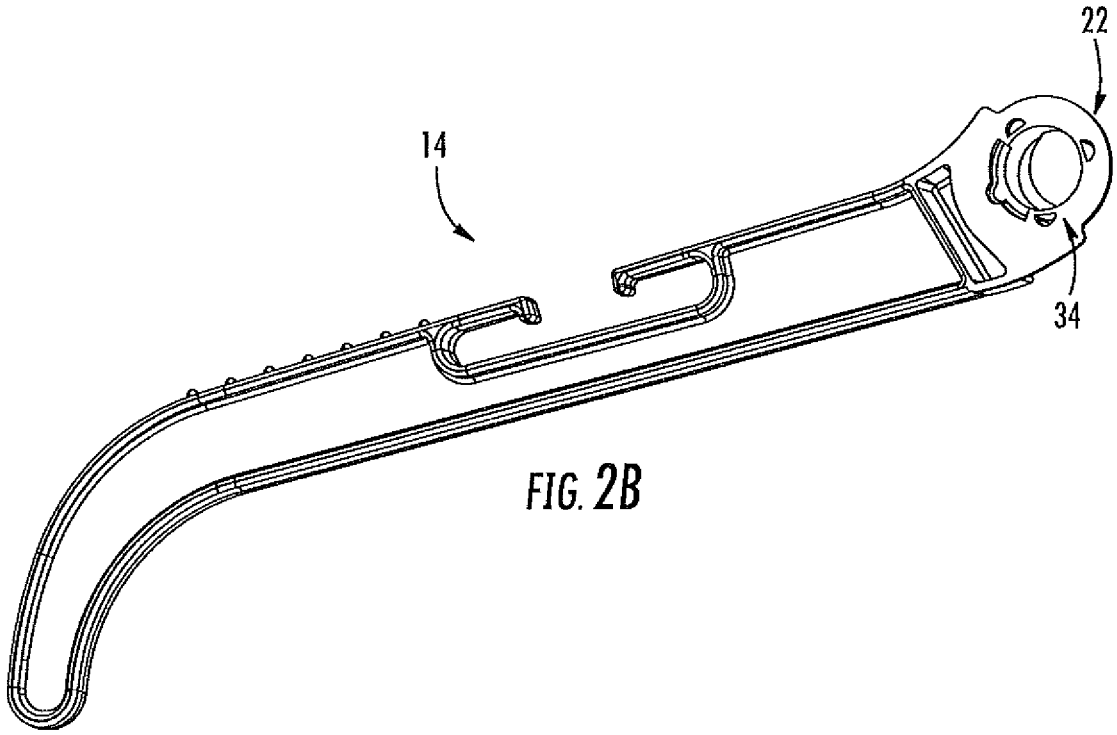
FIG. 2*b* is a rear perspective view of the collapsible arm of FIG. 2*a;*

FIG. 1*c* is a rear view of FIG. 1*b* with pivotable and foldable hook 18 included. FIGS. 2*a* and 2*b* are front and rear perspective views of arm 14 which can be used as right or left arms for the hangers. Hanger arm 14 has a substantially circular cantilevered projection 21 at an inner end 22 with three tabs 24 to hold arms 14 to the central neck and hanger body formed on the radial surface 26 of circular projection 21 and a cantilevered positioning nub 28 projecting from radial surface 26.

Figure 3:
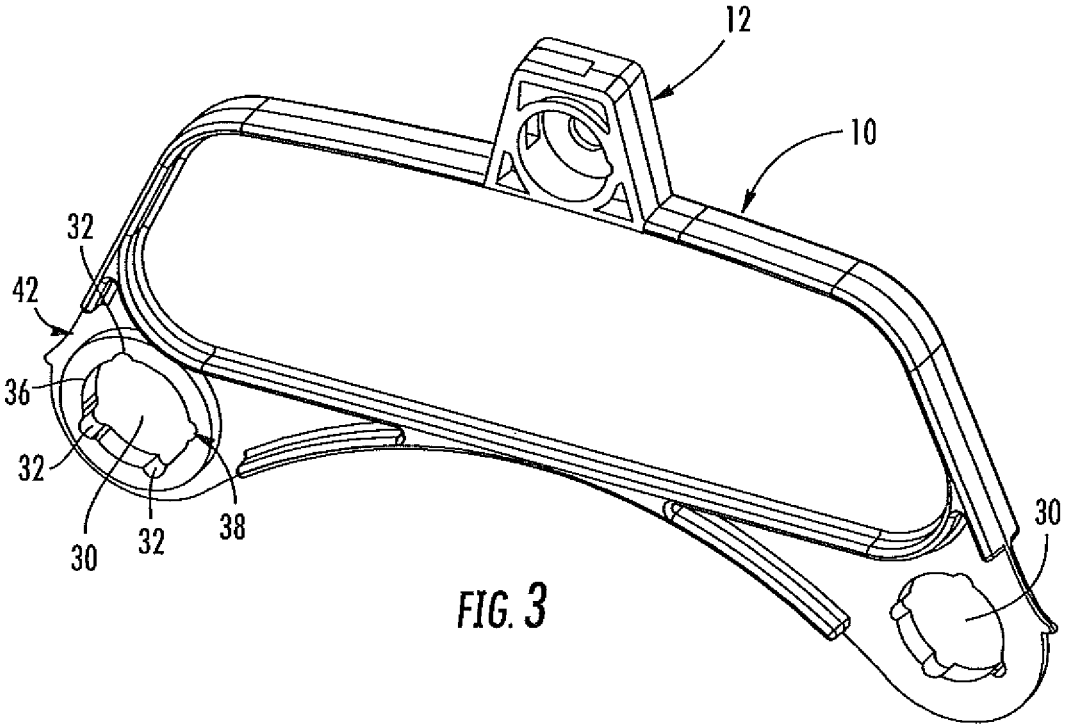
FIG. 3 is a front perspective view of the central neck portion of the hanger of this invention.

The cantilevered nub 28 and its circular projection 21 are also shown in U.S. Pat. No. 9,655,466 ('466, having the same inventors as for the present invention) as nub 46 and hook attachment circular member 40 of FIG. 4*a* and the description of the operation of that rotatable hook attachment mechanism 40 is substantially the same as applied to circular projection 20 in this invention. The contents of U.S. Pat. No. 9,655,466 are incorporated herein by reference. Additionally, the attachment between circular projection 21 and nub 28 of this invention is substantially similar to the mechanism of FIGS. 3A and 3B of the '466 patent. The '466 patent describes a cantilevered projection system as well as a closed projection system with respective nubs to achieve the pivot and removal functions as are achieved in this invention. Either a closed or cantilevered system can be used with the present invention.

Projection 21 and retainer tab 24 locks into hole 30. Retainer tabs 24 align with recesses 32 for easy assembly and frictional holding of the arm in hole 30. Back bearing surface 34 presses against the perimeter 36 around hole 30 for stability for the complete assembly. Positioning nub 28 is attached to cantilevered flexible member 29 and allows positioning nub 28 to align with recess 38 (FIG. 3) to position and hold the arms to be in the standard horizontal positon. Upper arm stop 40 prevents the arm 14 from being positioned above the horizontal plane. Lower arm stop 42 prevents the arm 14 from being positioned beyond the vertical plane when butting up against central head arm stop 44 (FIG. 1*c*).

Central neck 10 is symmetrical so that the hanger arms 14 can be attached in holes 30 in the left or right pivots 16 of central neck 10. Each arm 14 is molded to the same shape for ease in assembly with no specific right or left sides to confuse the assembler.

Figure 4:
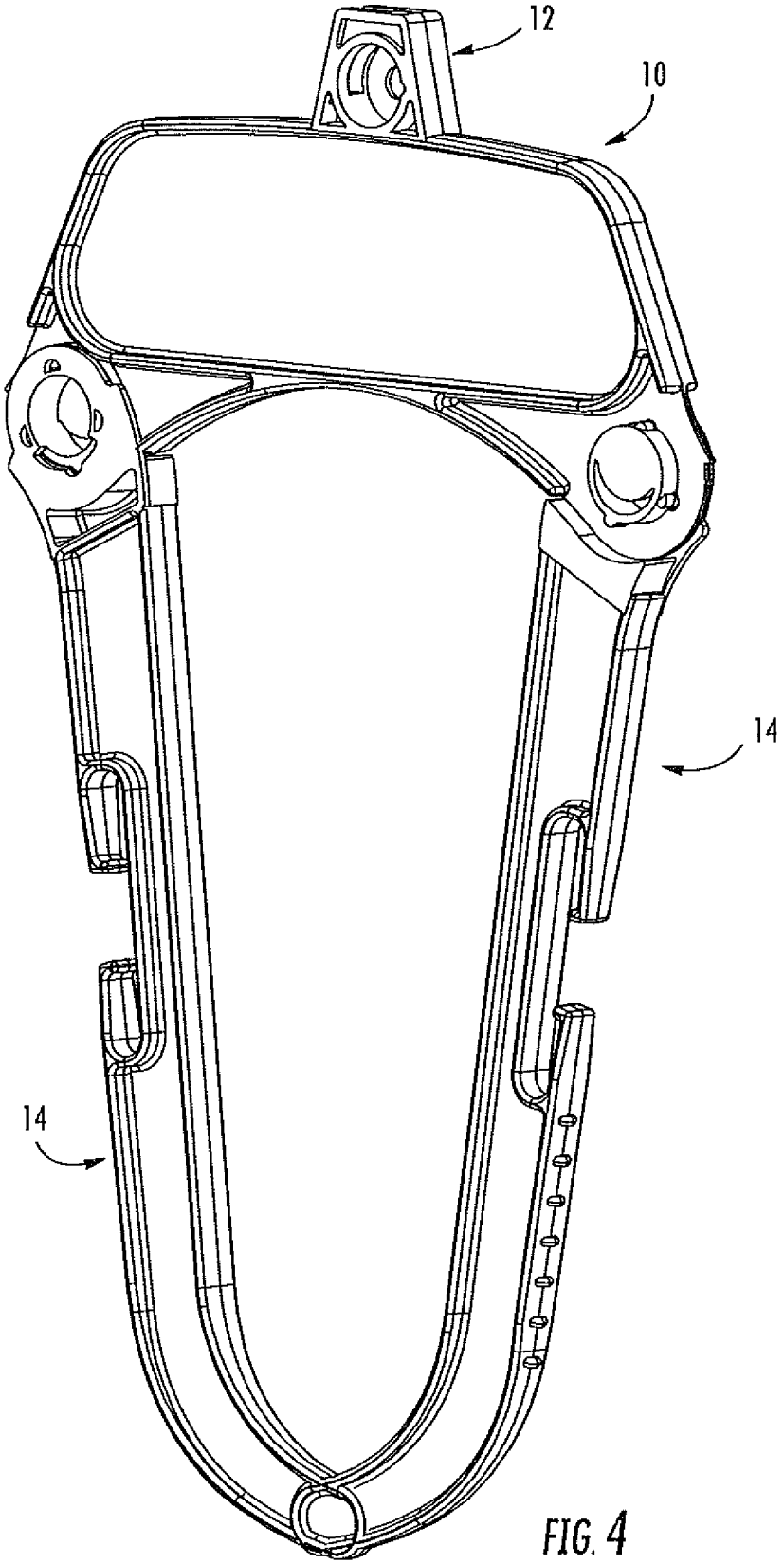
FIG. 4 is a perspective view of the hanger arms in collapsed positions.

FIG. 1*a*, which is a complete assembled hanger, shows the pivotable arms 14 pivoted into the upright horizontal position and functions as a conventional garment hanger for supporting and displaying a garment. However when the arms 14 need to be collapsed to remove or insert into a buttoned or closed neck garment as shown in FIG. 4, the cantilevered hanger arms can be collapsed by pressing down on the arms or the hook which forces nub 28 of cantilevered member 29 to be free to rotate on projection 21. Collapsible arms 14 employ a locking mechanism that allows for the hanger arms to remain upright (horizontal) and "locked" into position for display but may be easily folded or collapsed when the need to remove them from a closed neck garment or buttoned garment is required. The simplicity of the pivotable movement of the arms using the nub 28 and releasing it from a locking position will be cost effective to manufacturers, easy to assemble and simple for pivoting and locking the arm 14 in the upright or folded positions.

Figure 5A:
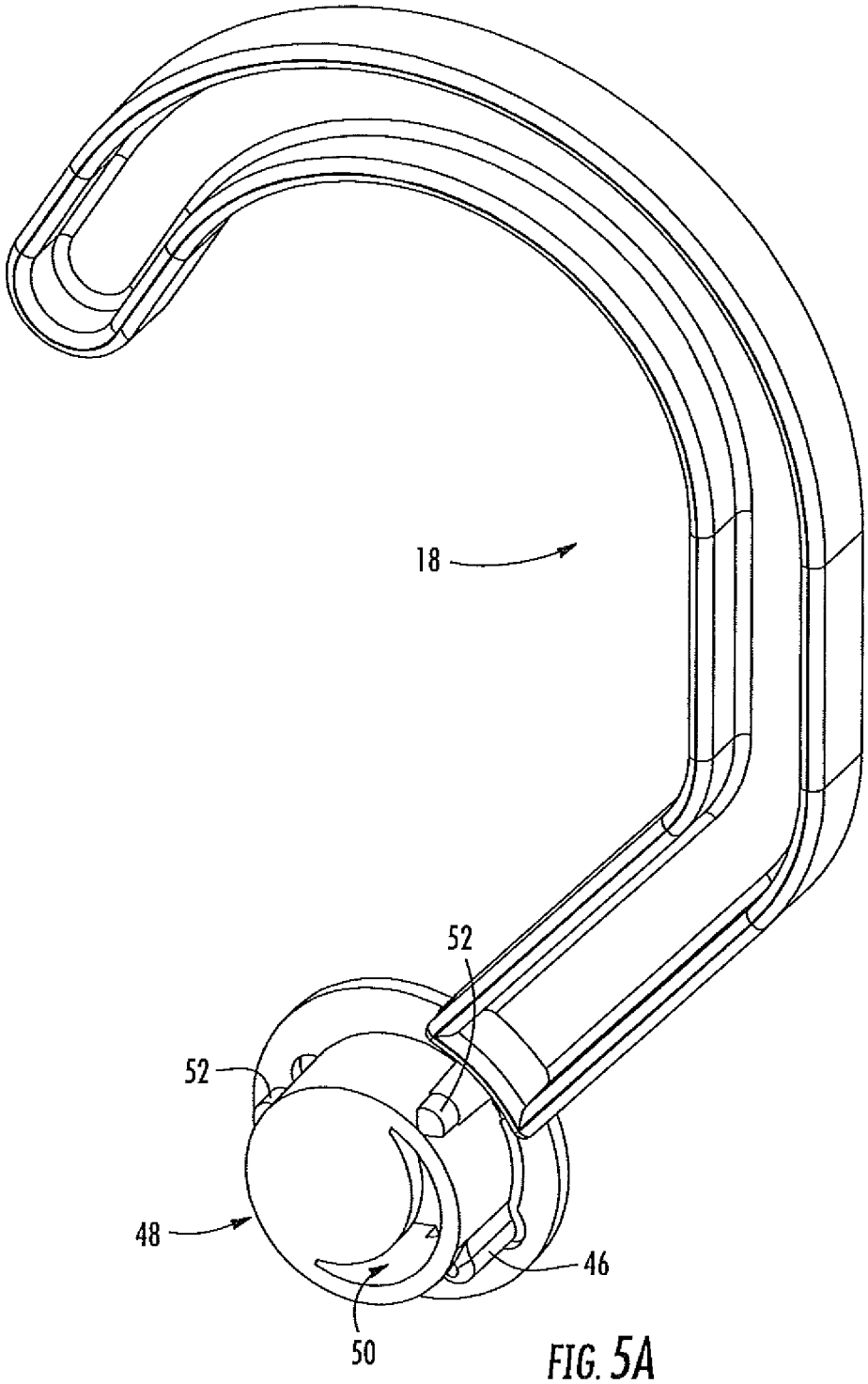
FIG. 5*a* is a front perspective view of the collapsible hook portion of this invention.
Figure 5B:
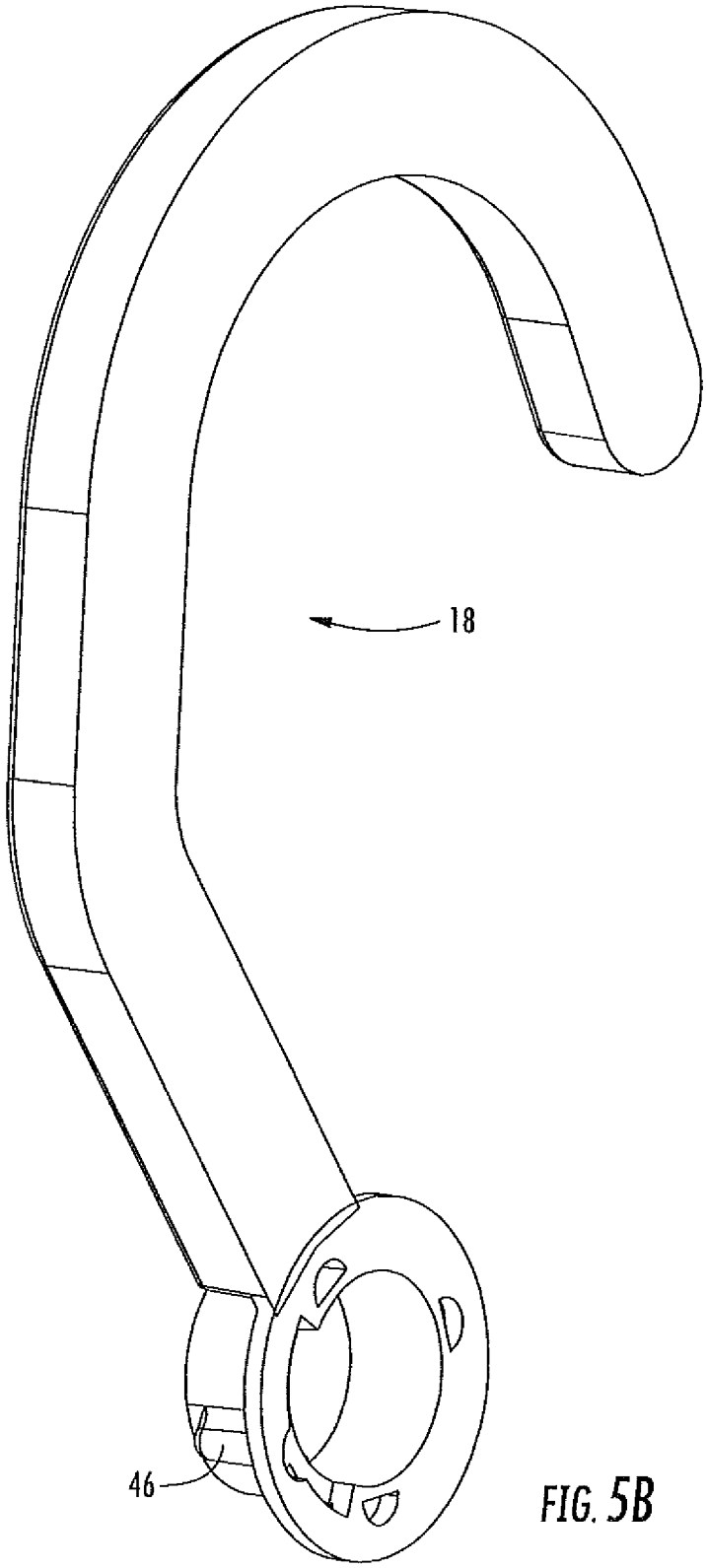
FIG. 5*b* is a rear perspective view of the collapsible hook shown in FIG. 5*a;*

FIGS. 5*a* and 5*b* shows the folding plastic hook 18 (see FIG. 1*b*) using the same principles as for the arms to collapse the hook 18 in the same manner used for the pivotable and collapsible arm mechanism. Projecting nub 46 formed on cylindrical projection 48 is of the closed version described above as well as described in the '466 patent. When nub 46 is pushed inward toward the open rear 50 behind nub 46, nub 46 is released from its respective recess. Retaining tabs 52 fit into respective slots 54 (see FIG. 1*c*) to hold the hanger hook to the central neck 10 of vertical and folded and connected to central neck 10.

As discussed above the collapsed state of the hanger provides a reduced footprint for the hanger creating a space savings in packaging and transport. In order to save time and expense at a retail distribution center level, the hanger can either remain as a conventional hanger or the arms 14 can be collapsed for easy removal when the hanger is not wanted in e-commerce use or when looking to save space in dimensional packaging reducing the footprint of box and space required in shipping.

Figure 6:
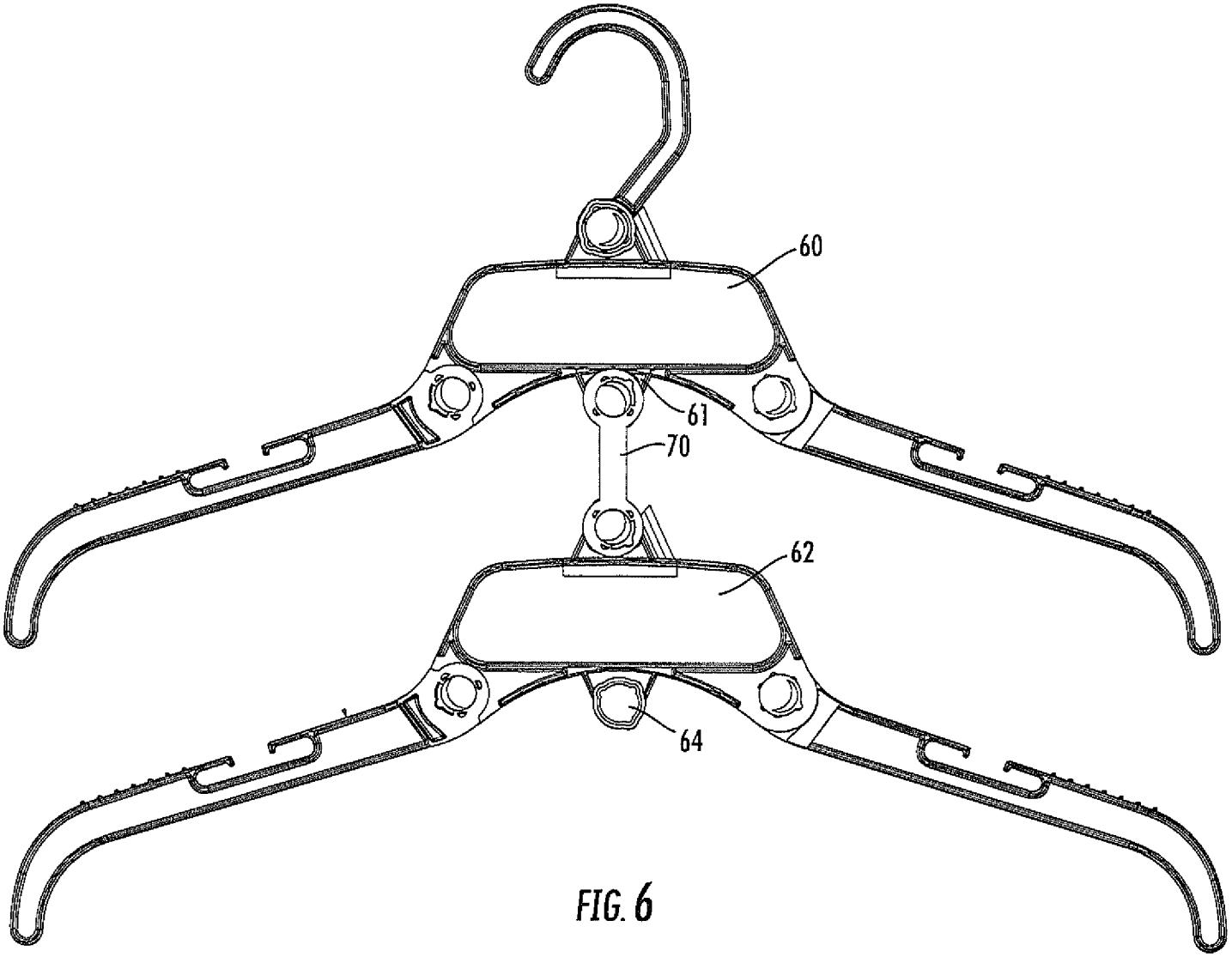
FIG. 6 is a front view showing similar hangers connected by the connector tab of this invention.
Figure 7:
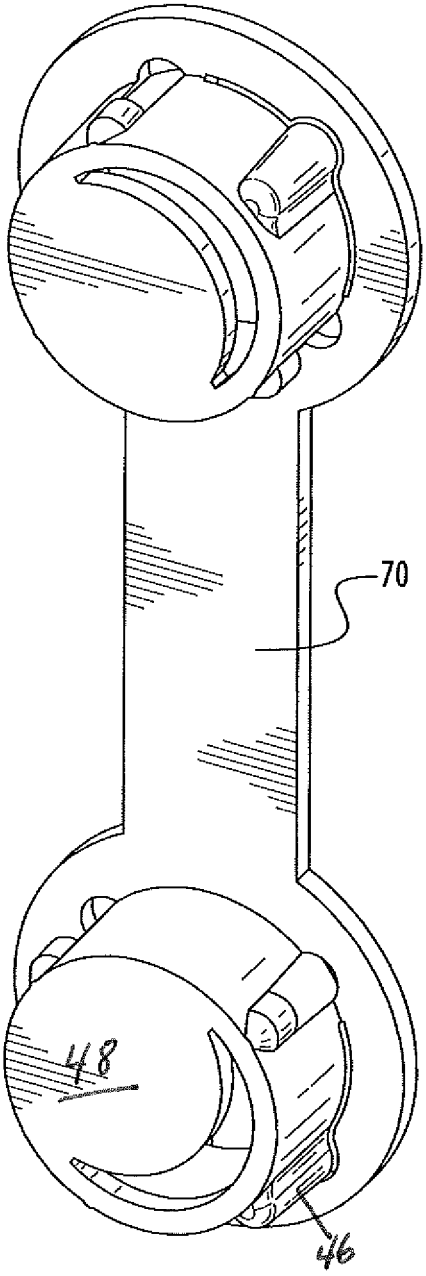
FIG. 7 is a front perspective view of the connector tab used in FIG. 6.

FIG. 6 is a front view showing two hangers 60 and 62 connected together by the coordinate loop 61 in connector 70 of FIG. 7. The same mechanism used for rotating the arms to the hanger body and arms to the central neck is used for the connector 70 in FIG. 7 by pushing down on connector 70 which forces nub 46 to be released to remove connector 70 from the hanger. Two hangers may be connected together by the connector 70, and the hangers need not be of the same silhouette or size. Connector 70 allows the hangers to be connected together with the locking nub 46 holding the connector in place, and a hanger can be removed from the connector 70 by rotating cylindrical projection 48.

Use of the connector as shown in FIG. 7 allows a modular set of related hangers to be shipped together and be connected together so as to enable suitable use of the multiple hangers when removed from the connectors.

It should be understood that the preferred embodiment was described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly legally and equitably entitled.

LIST OF PARTS

8 Hanger
10 Central neck
12 Hook and sizer mount
14 Hanger arms
16 Pivots
18 Plastic hook
20 Circular projection
21 Cantilevered projection
22 Inner end of hanger arm
24 Retainer tab
26 Radial surface of circular cantilevered projection
28 Cantilevered positioning nub
29 Cantilevered flexible member
30 Hole
32 Recesses
34 Back bearing surface
36 Perimeter around hole 30
38 Recess for nub 28
40 Upper arm stop
42 Lower arm stop
44 Central head arm stop 44
46 Projecting nub
48 Cylindrical projection
50 Open rear
52 Retaining tabs
54 Slots
60 Hanger
61 Coordinate loop
62 Hanger
64 Receiving socket
70 Connector

The invention claimed is:

1. A versatile hanger enabling use of said hanger as a fixed standard hanger as well as a hanger with hanger arms collapsible to a vertical position permitting the hanger to be removed from a garment without having to open a top space for such removal, said versatile hanger comprising:

a hanger body having a central neck to which a hanger hook is connected, said hanger body comprising openings at opposite ends of said central neck;

hanger arms connected to and pivotably movable in respective openings enabling said hanger arms to be held and fixed in a standard horizontal position and be collapsed by pivoting said hanger arms with respect to said central neck, said hanger arms being interchangeable such that said hanger arms can be attached to said hanger body at opposite ends thereof, said hanger arms removeable from said openings, each hanger arm comprising a circular projection tab located at an inner side of said hanger arm, said circular projection tab being pushed into or removed from said opening, said hanger arms being attached on the left and right sides of said central neck, said hanger arms defining a substantially vertical space, said hanger arms moving within said vertical space when in said vertical or horizontal positions or anyplace therebetween.

2. A versatile hanger as described in claim 1, wherein said hanger arms are identical in structure whether used on either side of said hanger body.

3. A versatile hanger as described in claim 1, wherein said hanger hook is pivotably moveable to either substantially vertical or horizontal positions.

4. A versatile hanger as described in claim 1, wherein said central neck comprises a pivot for said hanger hook.

5. A versatile hanger as described in claim 2, wherein said hanger hook is pivotably moveable to either substantially vertical or horizontal positions.

6. A versatile hanger as described in claim 5, wherein said central neck comprises a pivot for said hanger hook.

7. A versatile hanger as described in claim 1, wherein said hanger arms are held in said substantially horizontal position by an interlock.

8. A versatile hanger as described in claim 7, wherein said interlock comprises a rotatable cylindrical member having a nub captured in a recess to lock said hanger arms in position.

9. A versatile hanger as described in claim 2, wherein said hanger arms are held in said substantially horizontal position by an interlock.

10. A versatile hanger as described in claim 9, wherein said interlock comprises a rotatable cylindrical member having a nub captured in a recess to lock said hanger arms in position.

11. A versatile hanger as described in claim 1, wherein said hanger is molded.

12. A versatile hanger as described in claim 11, wherein said hanger is molded plastic.

* * * * *